United States Patent [19]

Hain et al.

[11] Patent Number: 4,460,091

[45] Date of Patent: Jul. 17, 1984

[54] BAG RESEALING CLIP

[75] Inventors: Paul O. Hain, Hamilton; J. George Lepisto, Middletown, both of Ohio

[73] Assignee: Champion International Corporation, Stamford, Conn.

[21] Appl. No.: 413,972

[22] Filed: Sep. 1, 1982

[51] Int. Cl.[3] ..... B65D 33/20; B65D 33/30

[52] U.S. Cl. ..... 206/621; 206/632; 383/68; 383/90

[58] Field of Search ..... 383/68, 69, 85, 86, 383/90; 206/620, 621, 632; 229/176; 24/30.5 R, 30.5 W, 3 J, 3 L

[56] References Cited

U.S. PATENT DOCUMENTS

| | | | |
|---|---|---|---|
| 813,440 | 2/1906 | Manahan | 383/68 |
| 1,985,326 | 12/1934 | Orr | 150/9 |
| 1,989,304 | 1/1935 | Andreas | 229/55 |
| 2,021,609 | 11/1935 | Pippert | 383/69 |
| 2,113,927 | 4/1938 | Alfred | 229/51 |
| 2,143,940 | 1/1939 | Craig et al. | 229/51 |
| 2,151,523 | 3/1939 | Orr | 229/66 |
| 2,203,924 | 6/1940 | Pletscher | 220/66 |
| 2,209,570 | 7/1940 | Kraft | 383/68 |
| 2,551,312 | 5/1951 | Bokich | 383/69 |
| 2,629,916 | 3/1953 | Footlick | 24/30.5 R |
| 2,985,545 | 5/1961 | Leavitt | 117/143 |
| 3,011,691 | 12/1961 | McGlynn et al. | 229/86 |
| 3,074,610 | 1/1963 | Pugh | 229/17 G |
| 3,081,930 | 3/1963 | Owens | 229/66 |
| 3,086,264 | 4/1963 | Tindall | 383/68 |
| 3,217,967 | 11/1965 | Jackson | 229/17 G |
| 3,279,009 | 10/1966 | Deane | 24/3 J |
| 3,381,883 | 5/1968 | Harris | 229/17 G |
| 3,426,936 | 2/1969 | Palmer | 220/53 |
| 3,648,922 | 3/1972 | Gebo | 229/62.5 |
| 3,661,693 | 5/1972 | Pierson | 383/68 |
| 3,850,366 | 11/1974 | Saito | 206/616 |
| 3,852,702 | 12/1974 | Dowling | 24/30.5 R |
| 3,893,460 | 7/1975 | Karami | 206/633 |
| 4,311,173 | 1/1982 | Sailors, Jr. | 141/68 |
| 4,316,574 | 2/1982 | Lepisto | 229/62.5 |

FOREIGN PATENT DOCUMENTS

| | | | |
|---|---|---|---|
| 867493 | 2/1953 | Fed. Rep. of Germany . | |
| 469192 | 2/1914 | France . | |
| 449402 | 4/1968 | Switzerland | 383/86 |
| 432821 | 8/1935 | United Kingdom . | |
| 891974 | 3/1962 | United Kingdom | 229/176 |

*Primary Examiner*—Stephen P. Garbe

*Attorney, Agent, or Firm*—Evelyn M. Sommer

[57] ABSTRACT

An elongated, plastic resealing clip is provided for a bag containing a flowable product and comprising a plurality of panels hingedly coupled along fold lines, an opening at one end of the bag, and a flap hingedly coupled to one panel along a fold line for overlapping an opposite panel and closing the opening. The clip is U-shaped in transverse cross section with a bight for engaging the flap fold line and depending legs for pressing the flap against the opposite panel. An adhesive layer extends across the entire width of the flap to seal the flap to the opposite panel. The adhesive layer seal can have a reduced bonding strength adjacent one end of the flap to facilitate opening of the flap at the reduced bond strength section. The reduced bonding strength is provided by an adhesive coating comprising kaolin clay. This arrangement is particularly useful in heavy weight bags which are sealed by a hot melt adhesive.

8 Claims, 5 Drawing Figures

BAG RESEALING CLIP

Cross-References to Related Applications

This application is related to Applicants' copending United States patent applications Ser. No. 419,736, filed Sept. 20, 1982, entitled "Container With Easy Opening Closure", and Ser. No. 413,725, filed Sept. 1, 1982, entitled "Container With Resealable Closure", which applications are incorporated herein by reference.

Background of the Invention

1. Field of the Invention

The present invention relates to an elongated plastic clip for sealing a flap closing one end of a bag which can be used an unlimited number of times.

2. Description of the Prior Art

Containers or bags formed of heavy weight, multiple ply paper are conventionally employed for containing, storing and shipping flowable, fine powdery materials and small sized granular products, such as starch, food products, chemicals, cement and the like. The flowable nature of these products permits the bags to be filled by inserting a filler spout of a dispensing machine into an opening of the bag and delivering the product from a source through the spout into the bag. The bag construction and filling apparatus for filling bags in this manner are disclosed in U.S. Pat. No. 4,316,574 to Lepisto, which patent is hereby incorporated by reference.

One problem which has plagued bags of this type is the provision of a simple and neat way to open and reseal the bags. Often heavy weight bags have no provision to facilitate opening and require the use of a sharp instrument to cut an opening in the bag. Such opening procedure is inconvenient and dangerous. Additionally, opening the bag using a sharp instrument often results in tearing of the bag or forming too large an opening preventing proper resealing for storing any remaining bag contents and preventing controlled disensing of the contents.

Hand opening of conventional heavyweight bags sealed with hot melt adhesive is extremely difficult due to the strength of the bag material and the seal. Force applied to the closing flap will tear the bag since the bond between the adhesive and paper is stronger than the paper itself. Thus, hand opening of such bags is difficult, forms a poor dispensing spout, causes spilling of the contents, and prevents resealing of the bag.

Special mechanisms for opening bags have involved the use of strings, e.g., U.S. Pat. No. 2,203,924 to Pletscher and U.S. Pat. No. 2,151,523 to Orr, the inclusion of a glued tab, e.g., U.S. Pat. No. 3,081,930 to Owens and the use of tape, e.g., U.S. Patent application Ser. No. 243,829, filed Mar. 16, 1981, entitled "Easy Open Valve Bag".

The previously tried closure opening mechanisms have suffered from numerous deficiencies, including a high failure rate, difficult and expensive manufacturing, adverse effects on the sealing of the bag and difficult operation. The string often fails by becoming loose from the bag without tearing the bag material and is difficult and expensive to install due to the precise gluing necessary. The thick material of the bag often makes the tab and tape mechanisms difficult to open. Additionally, such opening mechanisms provide a relatively large opening making controlled dispensing of the contents and resealing of the bag difficult.

Thus, previous systems for opening heavyweight bags for powder and granular substances have not been effective since they are difficult and expensive to manufacture, have a high failure rate, are difficult to operate and do not form a neat pouring spout for accurately dispensing the bag contents. Additionally, these systems make it extremely difficult or impossible to reseal the bag to properly store any unused contents in the bag, and have no provision for securely resealing the bag.

For products, such as yeast and dog food, the bag is often opened and resealed repeatedly each time some of the bag contents are used. Thus, a mechanism is needed by which the bag can be quickly and easily opened for removal of the contents and then securely closed for storage of the remaining contents a relatively large number of times.

Summary of the Invention

It has now been discovered that the disadvantages associated with conventional systems for opening and resealing bags having a flap closing one end of the bag can be eliminated by the bag resealing clip of the present invention which comprises an elongated, unitary member formed of resilient plastic and being generally U-shaped in transverse cross section with two generally parallel legs joined at their adjacent ends by a curved bight. The expression "unitary" means that the structure is continuous and is formed as one piece, e.g., by extrusion. When the clip is removably mounted on a bag with a plurality of panels and a flap hingedly coupled to one of the panels to close the bag opening, the bight overlies the flap fold line, one clip leg overlies the one panel and the other clip leg overlies the flap. The legs press the flap against an opposite panel to seal the bag.

In this manner, the bag can be easily reopened and resealed a substantially unlimited number of times by removing and remounting the clip on the bag. Additionally, the clip can be simply and easily manufactured and permits the bag to be securely, quickly and simply resealed without using additional equipment or materials such that the bag is self-equipped. The initial attachment of the clip can be accomplished simply and quickly without substantial modification to conventional bag manufacturing processes and apparatus.

Preferably, the bag has a plurality of panels hingedly coupled along fold lines, an opening at one end of the bag, and a flap hingedly coupled to one of the panels along a fold line for overlapping a portion of an opposite panel and closing the opening. A hot melt adhesive layer extends across the entire width of the flap for adhering the flap to the opposite panel and initially sealing the opening. The adhesive bonding strength of a first section of the hot melt adhesive layer is reduced by providing a spot coating of abherent (abhesive) comprising kaolin clay on the opposite panel portion correspondiing to the first section of the adhesive layer. When the flap is folded and sealed in the conventional manner, the spot coating of abherent reduces, without eliminating, the adhesive bond strength of the seal between the flap and opposite panel at the first section adjacent one corner of the bag to permit the flap to be easily separated from the opposite panel portion. At the seal first section, separation occurs between the spot coating and the bag panel, rather than at an interface wth the hot melt adhesive.

A line of perforations can be formed in the flap extending perpendicularly from the juncture of the adhesive layer first section and the remainder of the adhesive layer to the flap fold line. This permits the multiple plies of paper forming the bag and the flap to be easily separated in a neat and simple manner providing a pouring spout from which the bag contents can be accurately dispensed. The clip and first section can be located adjacent the corner of the bag opposite the filling valve means such that the formation of the easy opening system does not interfere with the formation and operation of the filling mechanism.

The spot coating can be printed, sprayed or brushed on the bag during its manufacture. In this manner, the reduced bond strength of the seal first portion is automatically formed during the conventional bag sealing process.

The clip can extend from the corner of the bag adjacent the reduced strength seal first section to a point past the line of perforations to reinforce the initial seal at the first section and to securely reseal the portion of the flap which is raised to dispense the contents. The clip legs can extend beyond the distal edge of the flap to further enhance the resealing of the flap. The bight portion of the clip can have a radius of curvature greater than the spacing of the legs to enhance its resiliency and flexibility. To facilitate proper mounting of the clip, the plastic used to form the clip can be transparent.

Other advantages and salient features of the present invention will become apparent from the following detailed description, which taken in conjunction with the annexed drawings, discloses a preferred embodiment of the present invention.

Figure 1:
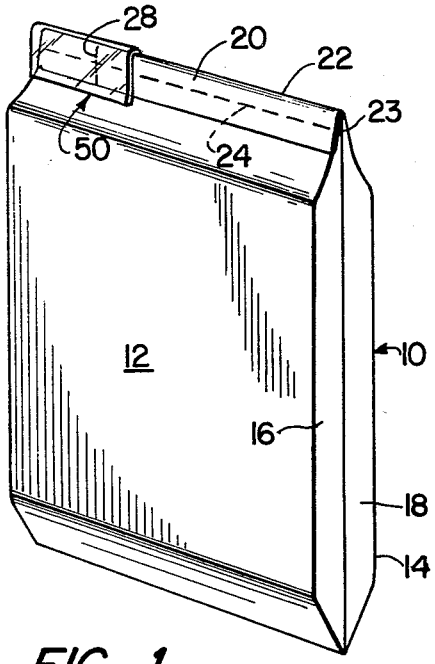
FIG. 1 is a perspective view of a bag and resealing clip in accordance wth the present invention.

Detailed Description of the Preferred Embodiment of the Invention

Referring to the drawings, the bag 10 of the present invention is primarily intended to contain a flowable matter comprising powdery or granular products, such as starch, food products, chemicals, cement and the like. The bag comprises a plurality of panels which are hingedly coupled along fold lines. Specifically, the bag has parallel front and back panels 12 and 14 joined at each side thereof by a pair of hingedly coupled side panels 16 and 18. A flap 20 is hingedly coupled to the one edge of back panel 14 along fold line 22. When folded over and adhered to front panel 12, flap 20 closes and seals the opening in bag 10 between the front, back and side panels at one end. A similar flap is provided at the opposite end of bag 10 to close the other opening of the bag. A bag resealing clip 50 is mounted adjacent one corner of the bag.

At one corner of bag 10, a suitable filling valve 23 is provided of the type disclosed in U.S. Pat. No. 4,316,574 to Lepisto. Since such valve is fully and adequately disclosed in the Lepisto patent, no further discussion thereof will be provided.

Flap 20 is adhered and sealed to panel 12 by a layer 24 of conventional hot melt adhesive formed on the inner surface of the flap adjacent its distal edge, i.e., remote from fold line 22. Layer 24 extends the entire width of flap 22 in order to completely seal the bag.

A spot coating 26 of suitable abhesive material is formed on the exposed surface of front panel 12. The material of coating 26 upon being heat sealed to the hot melt adhesive layer 24 will reduce the adhesion of the hot melt adhesive coated flap to the abhesive coated panel at a first section thereof which is co-extensive with spot coating 26. Although the spot coating reduces the bond strength at the location thereof, it does not totally eliminate the bond strength so as to provide a seal thereat.

Preferably, the abhesive material of coating 26 should have a fine particle size providing a large surface area capable of reducing the effectiveness of the hot melt adhesive and should have a laminated plate structure, as opposed to a crystal structure such as calcium carbonate. Additionally, the abhesive should be capable of being printed in combination with other materials by flexography and should be inert and/or of food grade material such that the bag can be used to contain food. Also, the abhesive should have very weak adhesion such that it will have enough dry integrity to resist dusting, but will split from the cellulose bag material. Finally, the abhesive material should have easily controlled release characteristics, i.e., relatively large changes in the quantity of material applied will have a relatively minor effect on the release qualities of the coating. The preferred abhesive of the present invention comprises kaolin clay.

The material should be applied in combination with a viscosity modifier, thickener or the like. Bentonite is preferred for such purpose. The addition of such material will reduce settling and facilitate application of the material by flexoprinting.

Other materials which may be used for abhesive coating 26 include, for example, silicones, fluoro chemicals and finally ground pearl starch. Although the silicones and fluoro chemicals function excellently to reduce the adhesion of the hot melt adhesive-coated flap to the abhesive-coated panel, such materials are disadvantageous due to their high cost.

A line of perforations 28 is formed in fold-over flap 20 such that it extends perpendicularly from and between the distal edge of flap 20 and fold line 22. The perforations are spaced from the adjacent corner of the bag a distance equal to the length of spot coating 26. As will be explained in greater detail hereinafter, the line of perforations facilitate tearing of the flap to form a neat pouring spout for dispensing the bag contents.

The bag is formed from multiple plies of paper in a conventional manner. In the illustrated embodiment, each panel has three plies. Additionally, a ply formed of a film of synthetic plastic material can be provided as an innermost ply which is suitably adhered to the innermost paper ply as required depending on the intended contents of the bag. The ends of the plies forming flap 20 are staggered or shingled as illustrated. Thus, the flap includes an outer back ply 30, a middle back ply 32 and an inner back ply 34. The top portion of front panel 12 extends above fold line 22, which top portion is defined by the shingled plies including an outer front ply 36, a middle front ply 38 and an inner front ply 40. Access to the bag interior is obtained by separating inner plies 34 and 40. Since the top portion of upper panel 12 extends above fold line 22 and is partially coated by adhesive layer 24, the bag is securely sealed upon closing and sealing of flap 20 such that the bag contents will not sift or otherwise escape from the bag.

Figure 5:
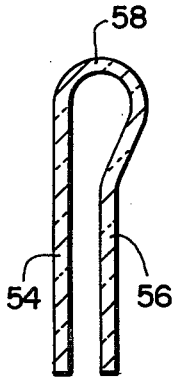
FIG. 5 is a side elevational view of the clip taken along line 5—5 of FIG. 4.
Figure 4:
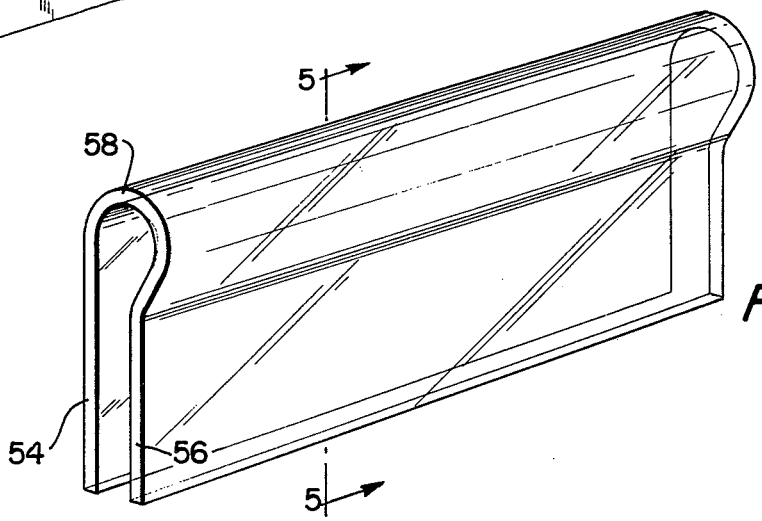
FIG. 4 is a perspective view of a bag resealing clip in accordance with the present invention.

Bag resealing clip 50 is formed as a unitary, one-piece, continuous member from resilient, transparent plastic. In transverse cross section, illustrated in FIG. 5, the clip is generally U-shaped with two generally parallel legs 54 and 56, joined at their adjacent ends by a curved bight 58. The clip bight has a radius of curvature greater than the spacing between the legs such that the clip cross-sectional configuration resembles that of a hair pin. Such cross-sectional configuration improves the resiliency and flexibility of the clip.

The clip is elongated such that its length is greater than the spacing of perforation line 28 from the adjacent corner and the length of abhesive coating 26. When one end of the clip is aligned with the bag corner, the clip extends beyond perforation line 28 before initial opening of the bag or beyond slit 52 formed by severing flap 20 along line 28 during initial opening of the bag. Additionally, legs 54 and 56 depend from bight 58 for a distance somewhat greater than the distance between flap fold line 22 and the distal edge of the flap such that the clip legs extend beyond the flap distal edge. By forming the clip relative to flap 20 in this manner, the clip will reinforce the weakened seal of the first section of the flap and will securely reseal the flap after the initial opening by maximizing the surface contact area between the appropriate clip leg and the flap and by covering perforation line 28 or slit 52 and the flap distal edge.

The bag of the present invention is basically formed in a conventional manner from a plurality of paper plies with a layer of adhesive 24 formed on the inner surface of flap 20 at its distal edge. Line 28 of perforations is formed in flap 20 and the portion of front panel 12 extending above fold line 22 spaced a distance (approximately 3 to 4 inches) from one corner of the bag as illustrated in FIG. 1. A spot coating is printed, sprayed or brushed on front panel 12 adjacent the same corner from the edge of the front panel for a distance corresponding to the spacing of the line 28 from the corner. The spot coating is spaced below fold line 22 a distance corresponding to the spacing of adhesive layer 24 therefrom such that layer 24 and coating 26 will overlap upon folding of flap 20 about line 22. Additionally, clip 50 is mounted as illustrated in FIG. 1. Thus, except for the formation of perforation line 28 and spot coating 26 and the mounting of clip 50, bag 10 of the present invention is formed in a conventional manner.

Figure 2:
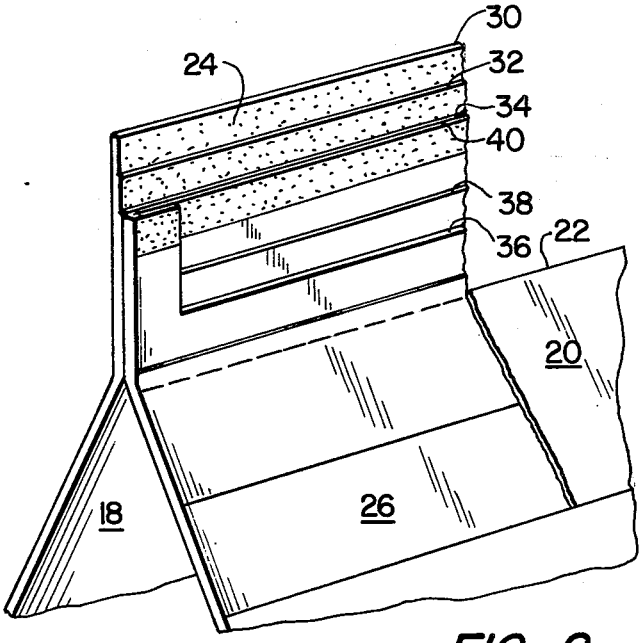
FIG. 2 is a partial, enlarged perspective view of the bag of FIG. 1 after it has been opened.
Figure 3:
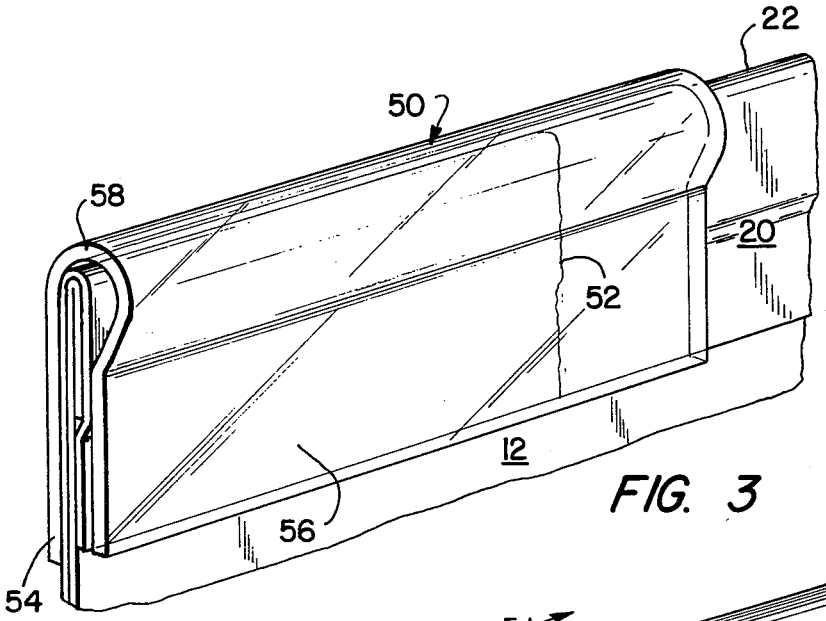
FIG. 3 is a partial, enlarged perspective view of the bag of FIG. 1 after it has been resealed.

Upon adhering flap 20 to panel 12 and mounting clip 50, a highly effective seal is provided for the bag. The bag can be easily opened by hand by gripping clip 50 and removing it from the bag and then gripping the corner of flap 20 adjacent its distal edge and coating 26. The reduced bond strength of the hot melt adhesive resulting from the provision of abhesive coating 26 causes the flap to separate easily from panel 12 along the spot coating. The flap is then torn along the line of perforations to form the configuration illustrated in FIG. 2. By separating inner plies 34 and 40 and extending the folded-in side panels 16 and 18, a neat and highly effective spout is formed from which the bag contents can be accurately dispensed. Since a neat, small opening is formed in the bag, it may be reclosed by refolding the raised portion of flap 20 and then remounting resealing clip 50 as illustrated in FIG. 3 such that the remaining contents in the bag can be safely stored.

Although the invention has been described in considerable detail, with particular reference to a certain preferred embodiment thereof, variations and modifications can be effected within the scope and spirit of the invention as defined in the appended claims.

What is claimed is:

1. A resealable bag for containing a flowable product, which comprises a plurality of panels hingedly coupled along fold lines;

an opening at one end of the bag;

a flap hingedly coupled to one of said panels along a fold line for overlapping a portion of an opposite panel and closing said opening, said flap having a free, distal edge remote from said fold line;

a resealable clip comprising an elongated, unitary member formed of a resilient plastic, said member being generally U-shaped in transverse cross section with two generally parallel legs joined at adjacent ends thereof by a curved bight, said clip being removably mounted on the bag with said bight overlying said flap fold line, one of said legs overlying said one panel and the other of said legs overlying said flap such that said legs press said flap against said opposite panel to seal the bag;

an adhesive layer formed on and extending across the entire width of said flap for adhering said flap to said opposite panel to seal said opening;

and a spot coating of abhesive means formed on said opposite panel for partially reducing, but not eliminating, the adhesive bonding strength of said adhesive layer on a first section thereof adjacent one corner of said bag to facilitate opening of said flap, while maintaining a seal at said first section prior to opening.

2. A resealable bag according to claim 1 wherein said flap has a line of perforations extending from the juncture of said adhesive layer first section and the remainder thereof to said fold line.

3. A resealable bag according to claim 2 where said clip extends from said one corner to a point past said line of perforations.

4. A resealable bag according to claim 1 wherein said flap has a line of perforations extending generally perpendicular to and between said flap fold line and said distal edge and dividing said flap into first and second longitudinally extending portions.

5. A resealable bag according to claim 4 wherein said clip extends from one corner of the bag to a point past said line of perforations.

6. A resealable bag according to claim 1 wherein said clip legs extend beyond said flap distal edge.

7. A resealable bag according to claim 1 wherein said plastic is transparent.

8. A resealable bag according to claim 1 wherein said clip bight has a radius of curvature approximately equal to the distance between said legs.

* * * * *